United States Patent [19]

Nelson

[11] Patent Number: 4,640,263

[45] Date of Patent: Feb. 3, 1987

[54] GRATE FOR ARTIFICIAL LOG

[76] Inventor: Gerald C. Nelson, P.O. Box 80816, Seattle, Wash. 98108

[21] Appl. No.: 720,031

[22] Filed: Apr. 4, 1985

[51] Int. Cl.[4] ..... F23H 13/00

[52] U.S. Cl. ..... 126/164; 126/153

[58] Field of Search ..... 126/152 R, 152 A, 152 B, 126/153, 164, 165, 163 R, 163 A, 298, 336; 211/60.1; 248/172, 149; D23/138.5

[56] References Cited

U.S. PATENT DOCUMENTS

| | | | |
|---|---|---|---|
| 893,671 | 7/1908 | St. John | 126/298 |
| 970,342 | 9/1910 | Kurt | 126/30 |
| 2,391,518 | 12/1945 | Sharpe | 126/165 |
| 4,140,102 | 2/1979 | Malecki | 126/164 |
| 4,161,171 | 7/1979 | Moncrieff-Yeates | 126/298 |

FOREIGN PATENT DOCUMENTS

| | | | |
|---|---|---|---|
| 2424727 | 1/1980 | France | 126/336 |

*Primary Examiner*—James C. Yeung

*Attorney, Agent, or Firm*—Seed and Berry

[57] ABSTRACT

A grate for holding a manufactured log (artificial log) has a pair of end supports which are adjustable along a pair of rods passing through the end supports. The log rests near its ends on saddles presented by the end supports and sags into engagement with the rods as it burns.

2 Claims, 5 Drawing Figures

FIG. 3
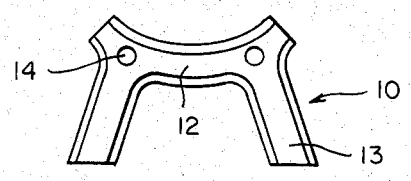
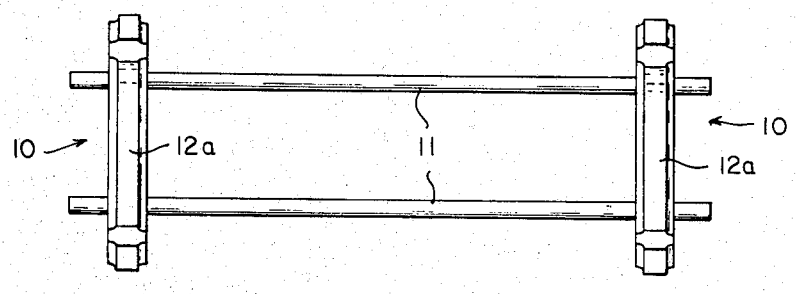
FIG. 4
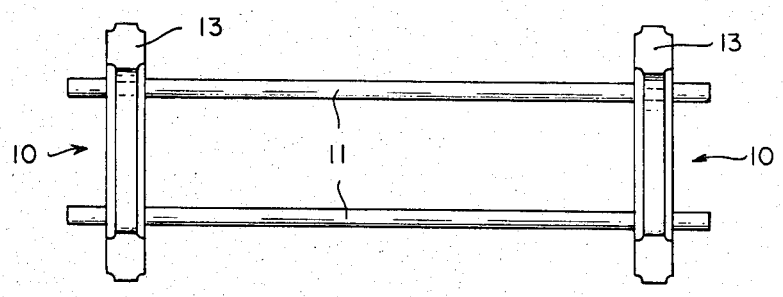
FIG. 5

GRATE FOR ARTIFICIAL LOG

DESCRIPTION

1. Technical Field

The present invention relates to fire grates, and more particularly to an improved adjustable grate for use with a single artificial log.

2. Background Art

Manufactured logs made of pressed sawdust and wax with a flame coloring agent, hereinafter referred to as "artificial logs," have become popular for use in fireplaces for added heat and visual appeal. These logs are normally burned one at a time and normally last two or three hours, depending on size and draft conditions. They vary from about 11 to 13 inches in length and vary in weight from about 3.5 to 6 pounds. Each artificial log has a loose paper wrapper formed with a longitudinal extension strip which is ignited by a match or lighter to start burning of the log. As the log burns it has an attractive colored flame, and hence, for maximum visual appeal it is preferred that most of the log be visible while burning. Also, it is preferred that the burning log have a gap underneath for air circulation, coals, and ash.

A pair of andirons is not suitable for supporting an artificial log because as the log burns it tends to sag and divide into longitudinal segments; hence the log needs center support by some form of grate. However, if a conventional grate is used so as to provide support along substantially the entire length of the log, too much of the log is blocked from view and the burning conditions for a single log are not ideal.

Although in the past most of the use of artificial logs has been in fireplaces, they also have appeal for use out of doors on patios and beaches and at camping sites. Accordingly, it is most convenient if a grate is to be used, that the grate be a knockdown structure, convenient for storage and transport, and one that can be very easily assembled. Also, because the artificial logs vary in length and circumference, it is preferred that the grate be easily adjustable in effective length and be otherwise adaptable for various log sizes.

DISCLOSURE OF THE INVENTION

Accordingly, the present invention aims to provide an improved grate unit of simple and economical knockdown construction which is easily adjusted in effective length and circumference, and is particularly suited for use with an artificial log to give good log visibility and burning conditions.

The objectives of the invention are accomplished by utilizing two metal end support members and a pair of parallel metal support rods which slidably pass through the end supports so that the distance between the end supports can be varied, and the end supports and rods can be separated from one another for more compact storage and transport. Preferably, the end support members are formed with saddles on which the end portions of the log rest.

A BRIEF DESCRIPTION OF THE DRAWINGS

FIG. 3 is an end view of the grate.

FIG. 4 is a top plan view of the grate.

FIG. 5 is a bottom view of the grate.

BEST MODE FOR CARRYING OUT THE INVENTION

Figure 1:
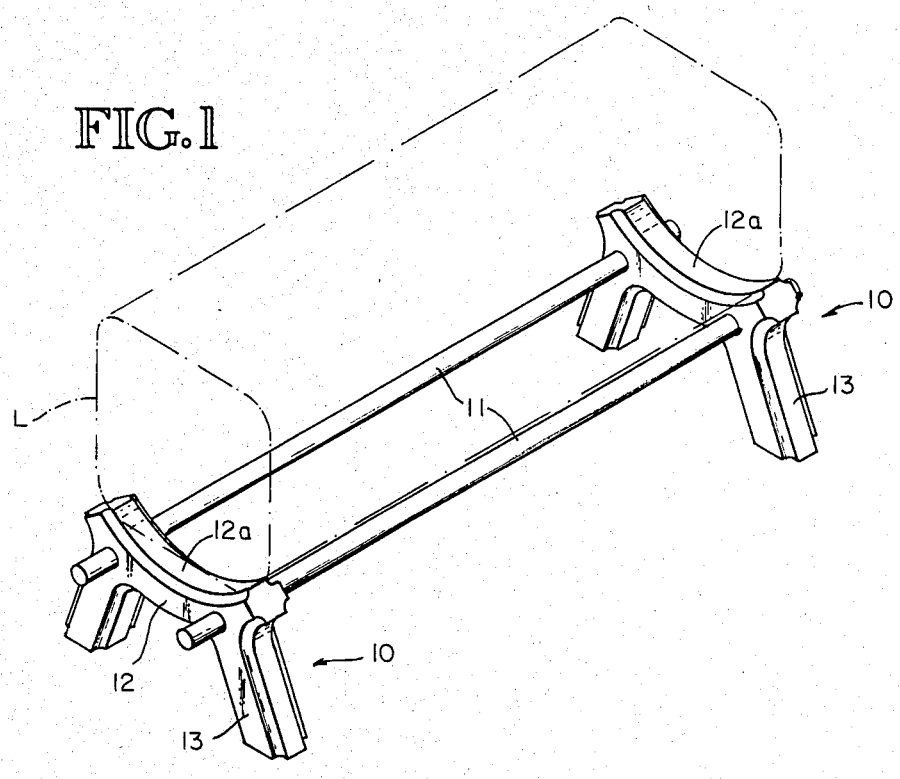
FIG. 1 is a perspective view of a grate embodying the present invention and shown supporting an artificial log in phantom.

Referring to the drawings, it is seen that the grate consists of a pair of like end supports 10 and a pair of rods 11. The end supports 10 each have a saddle portion 12 from which a pair of legs 13 depend. A pair of bores 14 extend through each saddle portion 12 adjacent the upper ends of the legs 13 to slidably receive the rods 11. The saddle portions 12 present upper concave surfaces **12*a* to support the outer end portions of an artitifical log L shown in phantom in FIG. 1. Preferably the legs 13 diverge from the saddle portions 12 and the latter extend laterally of the upper ends of the legs. The end supports 10 are preferably cast of a suitable metal such as zinc or aluminum in one piece with the bores 14 formed during the casting operation, and the rods 11** are preferably of steel.

It will be apparent that the grate can be easily assembled merely by passing the rods 11 through the bores 14 of the end supports 10. The resulting interfit between the rods 11 and the end support maintains the end supports in stable upright position.

Figure 2:
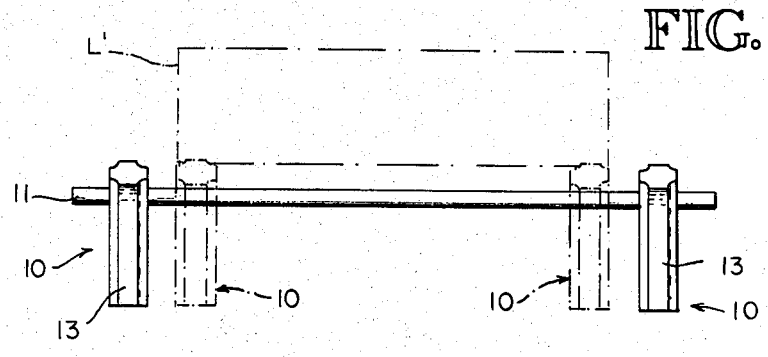
FIG. 2 is a side elevational view of the grate showing a shortened log supporting position in phantom.

When the grate is in use, it is preferred to adjust the distance between the end supports 10 so that the artificial log to be burned has its end portions seated on the saddle portions 12. For example, as shown in phantom in FIG. 2, the end supports 10 have been moved closer together along the rods 11 to accommodate a shorter log L'.

Initially the central portion of the log is spaced above the rods 11. As the log burns, it usually laterally fractures in several longitudinal locations and sags into engagement with the rods 11 which are close enough together relative to the log width to support the log while burning continues. As a result most of the log remains in clear view as it burns so that the colored flames can be enjoyed. At the same time, good air circulation is maintained beneath the log by the rods 11.

The grate unit can be compactly stored as four separate pieces in a bag or special metal container (not shown) adapted to serve as a hearth and wind deflector when the grate is used out of doors.

It will also be appreciated that, although specific embodiments of the invention have been described herein for purposes of illustration, various modifications may be made without departing from the spirit and scope of the invention. Accordingly, the invention is not limited except as by the appended claims.

I claim:

1. An adjustable grate for use with an artificial log, comprising:

a pair of identical upright end supports of unitary one-piece construction, each having an upper horizontal saddle portion presenting an upper concave support surface for receiving an end portion of the log and each having a pair of support legs of equal length depending from the saddle portion;

a pair of matching horizontal parallel rods of uniform cross-section slidably interfitting with the end supports by way of identical holes in said end supports located adjacent the upper ends of the legs and equidistant from the lower ends of the legs for giving intermediate support to the log when it sags while burning, the distance between said end supports being freely adjustable along the rods and the sliding interfit of the rods with said end supports maintaining the end supports in vertical parallel relation.

2. An adjustable grate according to claim 1 in which the pair of legs of each end support diverge from the saddle portion inwardly of the ends thereof and have flat coplanar lower end faces parallel to the rods.

* * * * *